US006026833A

United States Patent [19]

Conte

[11] Patent Number: 6,026,833

[45] Date of Patent: Feb. 22, 2000

[54] POCKETS FOR ATTACHMENT TO CRUTCHES

[76] Inventor: Cynthia Conte, 948 Michie Tavern La., Charlottesville, Va. 22902

[21] Appl. No.: 08/966,206

[22] Filed: Nov. 7, 1997

[51] Int. Cl.[7] ..... A45B 3/10

[52] U.S. Cl. ..... 135/66; 135/68; 135/73; 150/107; 224/407; 224/572

[58] Field of Search ..... 135/65–69, 73; 150/106, 107; 224/277, 407, 572, 901.4, 901.6; 182/65–69; 190/102; 280/769, 47.26, 47.38

[56] References Cited

U.S. PATENT DOCUMENTS

| | | | |
|---|---|---|---|
| D. 169,337 | 4/1953 | Reece | 280/47.34 X |
| 2,554,653 | 5/1951 | Wisecarver | 135/68 X |
| 4,295,483 | 10/1981 | Smith | 135/66 |
| 4,815,764 | 3/1989 | Carpenter | 280/42.46 X |
| 4,830,238 | 5/1989 | Widinski et al. | 224/42.46 |
| 4,850,383 | 7/1989 | McBride | 135/68 X |
| 4,917,160 | 4/1990 | Hart et al. | 150/106 |
| 5,101,845 | 4/1992 | Kravetz | 135/66 |
| 5,160,001 | 11/1992 | Marceau | 190/102 |
| 5,340,005 | 8/1994 | Woods et al. | 135/66 X |
| 5,465,884 | 11/1995 | Bohl et al. | 224/407 |
| 5,526,836 | 6/1996 | Sigsworth | 135/66 |
| 5,555,904 | 9/1996 | Stockwell | 135/68 |
| 5,642,749 | 7/1997 | Perryman | 135/66 |

*Primary Examiner*—Carl D. Friedman
*Assistant Examiner*—Winnie S. Yip
*Attorney, Agent, or Firm*—Sheldon H. Parker

[57] ABSTRACT

Pockets for use on a crutch consisting of a front panel and a back panel secured to one another along three sides, leaving an open end. Alternatively, the pocket has at least one side panel positioned between the front and back panels. The back panel preferably has a length greater than the length of the front panel and the width of the side panel to form a closure flap. The pocket securing portion is affixed to one end of the back panel proximate the open end and secured to the crutch at the horizontal top rail by eye hooks. A retaining strap proximate the closed end secures the pocket to the side rails. In another embodiment for use on the lower portion of the crutch, the back panel has a length at least twice the length of the front panel and is folded upon itself to form a U-shape. A channel is secured to the crook of the U-shape to form a channel to receive a retaining bolt secured to the side rails. A secondary layer is affixed to a second leg of said U-shape to form a second pocket.

14 Claims, 6 Drawing Sheets

POCKETS FOR ATTACHMENT TO CRUTCHES

BACKGROUND OF THE INVENTION

1. Field of the Invention

The invention relates to storage pockets which are easily attached to and removed from, crutches.

2. Brief Description of the Prior Art

Crutches have been used for years as a means of providing mobility for people with leg and/or foot injuries. While crutches allow a certain freedom in maneuverability over wheelchairs and walkers, crutches are not conducive to carrying articles.

Various devices have been developed over the years to solve the problem created by crutches in carrying items. These devices include various pouches attached to the crutch such as shown in U.S. Pat. No. 4,295,483 to Smith. The Smith pouch, however, is mounted below the handle which limits easy access to the pouch by the crutch user. This location also decreases the security of the pouch as the location allows accessibility by other people.

U.S. Pat. No. 5,101,845 addresses the transport of paper articles. However the clamping device shown therein appears to be relatively cumbersome and requires modification to the crutch proper. Such structures could interfere with the crutch assisted ambulatory movement of the user. The '845 patent also requires significant modification to the crutch structure which will increase the cost. Such devices may not be used by one-time users who are renting crutches as permanent modifications cannot be made to such leased crutches.

In U.S. Pat. No. 5,642,749 Perryman discloses a crutch pouch for transporting personal items as well as documents which is easily released from the crutch sides. As the Perryman patent uses hook and loop material to attach the pouch to the sides of the crutch, the pouch must either be provided with rigid sides, or not be over filled, to prevent the hook and loop material from separating. The use of securing means proximate the top of the pocket allows disclosed pockets to be "over-stuffed", if required, without being concerned that the pouch will separate from the crutch. Additionally, the nature of the '749 design restricts the width of the pocket which is too narrow for comfortable, easy access to articles at the bottom of the pocket. Average adult hands are too large for easy access to the pockets contents and the pocket would have to be removed and the contents, such as keys, lipsticks, etc. spilled out. The constant removal and attachment of the pocket would quickly deteriorate the adhesive holding the loop material to the crutch sides.

Further, many of the prior art pouches are not readily releasable from the crutch when the user is at the sites of departure or destination. Also access to many of the prior art pouches is not necessarily easy and in some instances it may become awkward to gain access to such pouch by the use without manipulation of the crutch itself. The disclosed pouches are designed to be readily accessed to the crutch user without substantial manipulation of the crutch.

SUMMARY OF THE INVENTION

A pocket system is disclosed which allows people to carry articles while using a crutch. The standard crutch has a pair of vertical side rails with a horizontal top rail, at least one pair of holes drilled in each of the vertical side rails, and a horizontal handgrip. In one embodiment, the pockets consist of a front panel and a back panel secured to one another along three sides, leaving an open end. The pockets can have a tailored configuration or a soft pouch design. In another embodiment, the pocket has at least one side panel positioned between the front and back panels. The back panel can have a length greater than the length of the front panel and the width of the side panel to form a closure flap, which extends over the open end. To provide for expansion, the side panel and/or front panel can be gusseted. The pockets can further be provided with a securing loop attached to the inside or outside of the pocket to receive a retaining bolt. An additional pocket can be added to the front panel of the pocket to hold small items, thereby allowing rapid, easy access to frequently used small items.

The pocket securing portion is affixed to one end of the back panel proximate the open end. The pocket securing portion is attached to the crutch securing device affixed to the horizontal top rail and dimensioned to receive the pocket securing portion. The pocket can be secured to the crutch through use of eye hooks and ties, snaps, etc. or, alternately, holes can be drilled in the horizontal top rail of user owned crutches.

A retaining strap, affixed to the pocket proximate the closed end, has a length sufficient to secure the pocket to the crutch vertical side rails. The retaining strap preferably has a length sufficient to wrap around the side rails.

In another embodiment, for use on the lower portion of the crutch, the back panel has a length at least twice the length of the front panel. The back panel is folded upon itself to form a U-shape, a first leg being affixed to the front panel. An enclosing strip is secured to the crook of the U-shape to form a channel dimensioned to receive the retaining bolt used to secure the pocket to the crutch. A secondary layer is affixed to a second leg of said U-shape to form a second pocket, with access being provided to the second pocket through the second leg. Separate closure can be provided for the open end of the pocket. A retaining strap is secured to the pocket proximate the closed end to secure the pocket to the crutch.

A document retaining strap can be incorporated which allows for long documents to be placed in the lower pocket and prevented from wobbling through use of the adjustable strap. The document retaining strap is wrapped around the sides of the crutch and secured through the use of a hook and loop material.

BRIEF DESCRIPTION OF THE DRAWINGS

The advantages of the instant disclosure will become more apparent when read with the specification and the drawings, wherein.

DETAILED DESCRIPTION OF THE INVENTION

The foregoing problems are overcome by the instant invention by providing a crutch pocket which is easily accessible and requires little alteration to the crutch. Further, by suspending the crutch pocket from the bracing bar of the crutch, there is no concern that the hook and loop material will separate, due to weight or size, causing the pouch to fall.

As can be seen from the following Figures and descriptions, the crutch pockets can take various forms, such as soft and unstructured or more tailored and structured. It should be noted that herein the term structured does not refer to a material rigidity but rather a design having a specific, more defined, contour. The pockets can be manufactured from any strong fabric, such as canvas, denim or netting, which will not tear during repeated access. Additionally, the exact methods of construction illustrated herein are used as examples only and other methods of stitching, trim and panel to panel overlay will become apparent to those skilled in the art.

Figure 1:
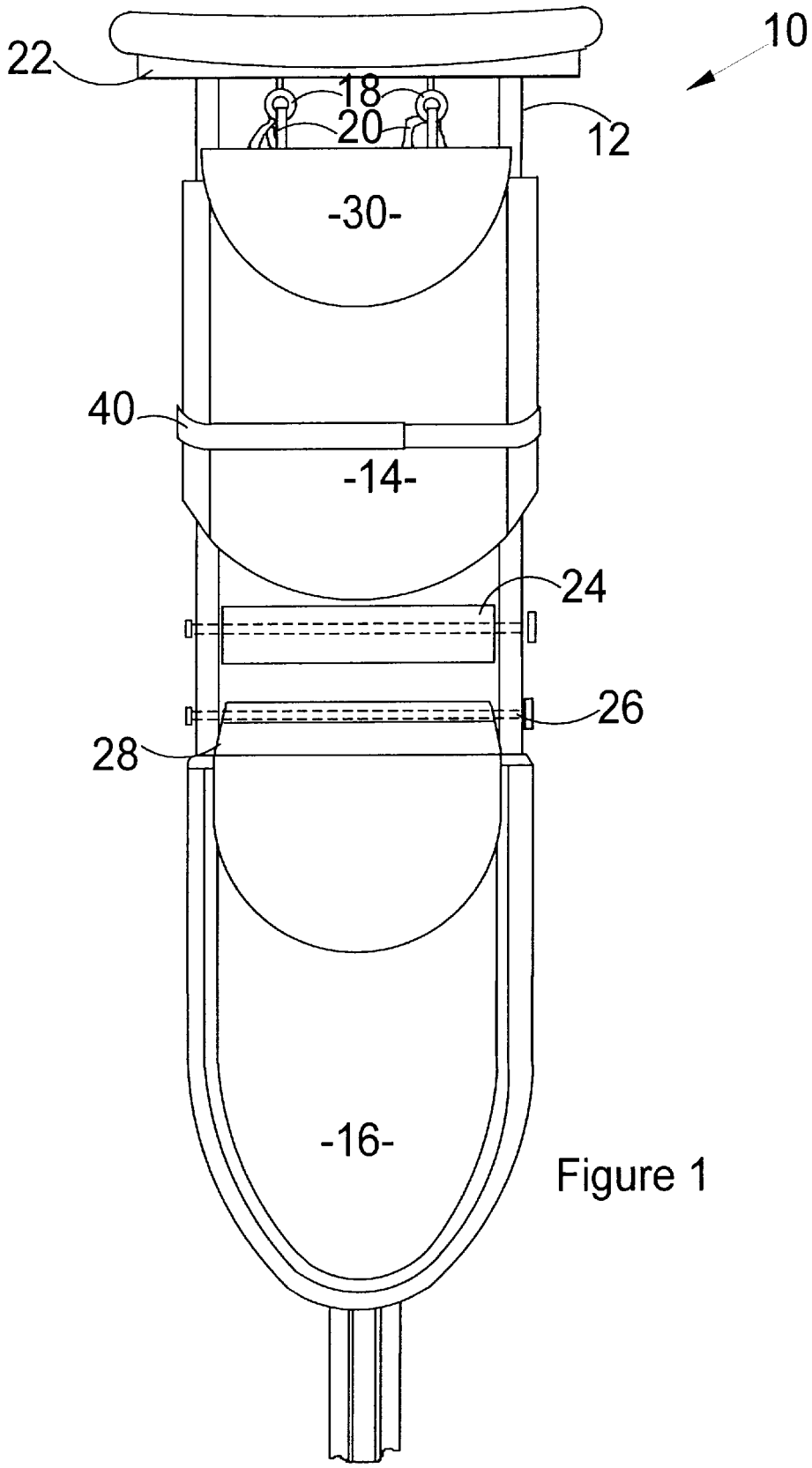
FIG. 1 is a front view of a crutch with two pocket embodiments attached.
Figure 2:
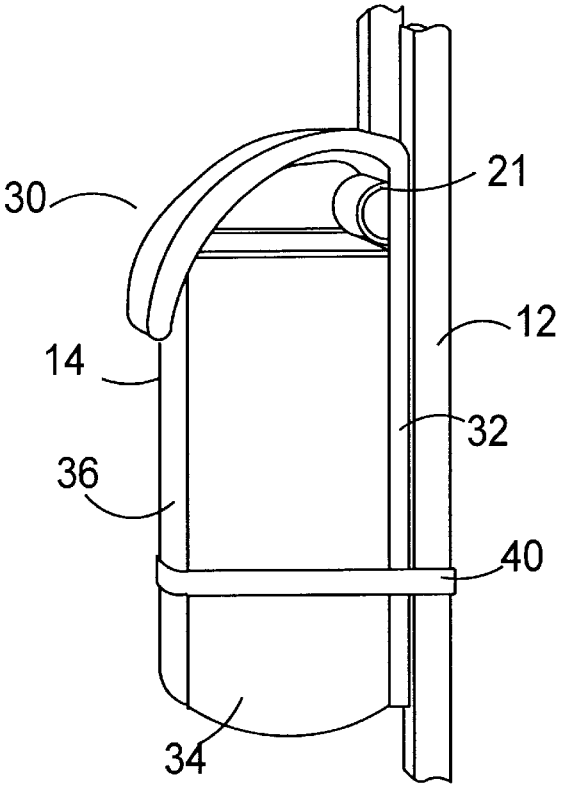
FIG. 2 is a side view of the hanging structured pocket of FIG. 1.

The crutch pocket assembly 10, as illustrated in FIG. 1, comprises two structured pockets, an upper hanging structured pocket 14 and a lower dual pocket 16. The hanging structured pocket 14 is provided with ties 20 at the top of the pocket 14 which are tied to eye hooks 18. All wooden crutches 12 are provided with a top horizontal support 22 which, in the disclosed invention, provides a place to affix the eye hooks 18. Although the ties 20 illustrated herein are actually looped through the eye hooks 18 and then knotted, hook and loop material, clip snaps, standard press snaps, or other attaching means, can also be used to affix the pocket 14. The means for hook and eye 18 attachment must, however, have sufficient strength to remain affixed during access to the pocket 14, as well as during movement of the crutch 12. The disclosed pocket can also be used with metal crutches where the use of a standard eye hook is not necessarily practical. For use with metal crutches an appropriate screw or hook can be substituted. Alternatively holes can be drilled directly through the horizontal brace and the ties 20 threaded through. In the event the ties 20 are threaded through drilled holes, the material ties should be replaced with rounded, or similar, cord to facilitate the threading process. The structured pocket 14 preferably also has a retaining strap 40 to maintain the pocket 14 in close proximity to the crutch 12. The retaining strap 40 can be attached to the pocket 14 by various means, the easiest of which is to stitch the strap 40 into the pocket structure between the side panel 34 and the back panel 32 during manufacture. The retaining strap 40 can be manufactured from hook and loop material, or consist of two material strips which are secured at their ends by means well known in the art. Alternatively, the retaining strap can be a single piece of strip of fabric, lacing or roping, which wraps around the crutches and affixes directly to the opposite side of the pocket. In an alternate embodiment, the retaining straps can be provided with one portion of hook and loop material with the crutch 12 rails being provided with the opposite portion of the material. The retaining straps would then be affixed directly onto the crutch rather than wrapping around the crutch and affixing to itself. To prevent articles from falling out of the pocket 14, a front flap 30 is provided which overlaps the top opening. As can be seen from the side view, the pocket 14, as illustrated in FIG. 2, is manufactured from three pieces of material to form a pocket with a depth which allows easy user access. The side panel 34 preferably has a minimum depth of about two inches, although other sizing can be used which is proportionate with the length and width of the pocket 14. To achieve maximum accessibility, the width of the side panel 34 should be sufficient to allow an adult to easily access the pocket 14. The side panel 34 is one continuous strip of material and forms both sides and the bottom of the pocket 14. The back panel 32 has a length approximately double that of the front panel 36 to allow for sufficient material to cover the filled pocket 14 and form the front flap 30. The front flap 30 can be allowed to simply overlap the front panel 36 or it can be affixed to the panel 36 through means known in the art such as hook and loop, snaps, buttons, etc. A channel 21 is preferably placed on the inside of the back panel 32 which provides the ability to use the pocket 14 on either the upper or lower portions of the crutch 12. To secure the pocket 14 on the lower half of the crutch 12, the retaining bolt 26 is placed through the channel 21 and secured, thereby replacing lower pocket 16. Although the pocket 14 is constructed as set forth above, alternative methods of construction, such as the front, bottom and back being formed from a single strip of fabric and separate side panels, will be evident to those skilled in the art.

Figure 4:
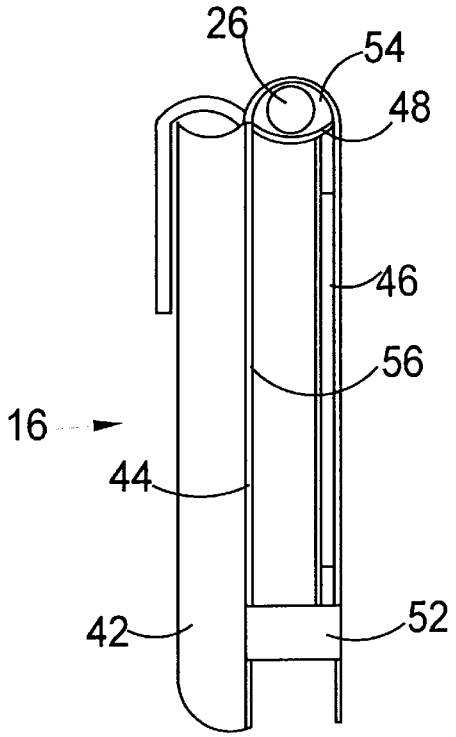
FIG. 4 is a side view of the double pocket structure of FIG. 1.

The proportions used for the pocket 14 must be compatible for user comfort. The depth of the pocket 14 must not be so great as to prevent easy use of the crutch 12 as the user's arm extends from the crutch top to the hand grip 24 and the pocket 14 is placed between the user's body and arm. Therefore, a pocket which has a substantial depth, would prevent efficient use of the crutch. Conversely, a pocket which has little depth, provides little advantage as a primary pocket. However, with the gusset 38, the crutch pocket owner determines width and comfort by how much he places in the pouch. Additional, smaller pockets 46 are described in conjunction with FIG. 4 hereinafter.

The width of the structured pocket 14 as illustrated is approximately the same as the crutch 12, however this is an approximate dimension and can be adjusted based on manufacture preference and consumer appeal. The length of the pocket 14 must allow for access to the hand grip 24 without any interference.

Figure 5:
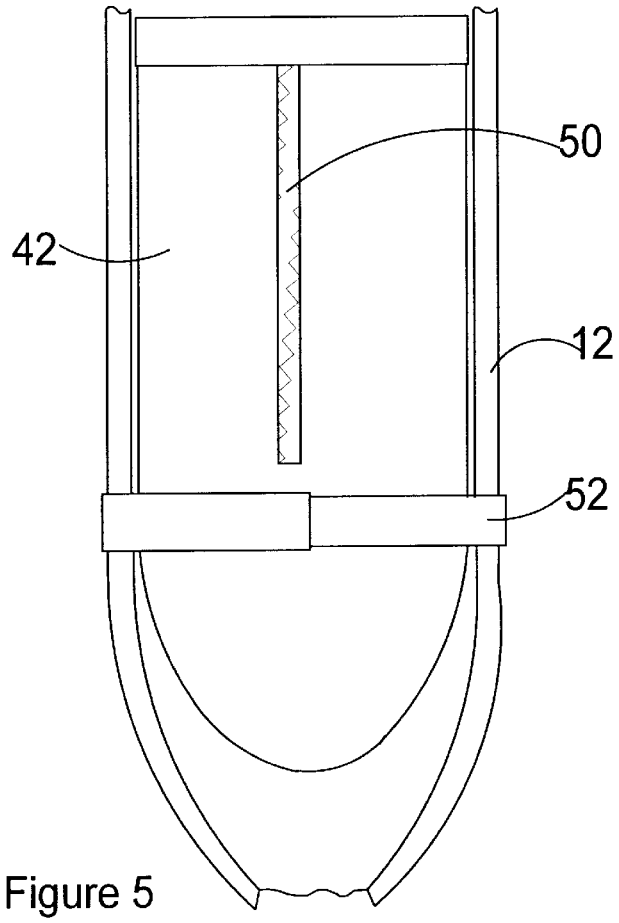
FIG. 5 is a front view of the inner pocket of the structure of FIG. 4.

The lower dual pocket 16 is held in place below the hand grip 24 through use of a retaining bolt 26 which has been placed through existing holes. In some instances, where the user has an arm length which requires use of the lower handgrip position, an additional pair of holes will need to be drilled to allow for use of a bottom pocket. To secure the lower dual pocket 16, the retaining bolt 26 is slipped through a channel 54 which is formed by affixing an enclosing strip 48 to the interior of backing 44. This is described in further detail hereinafter in conjunction with FIGS. 4 and 5.

Figure 3:
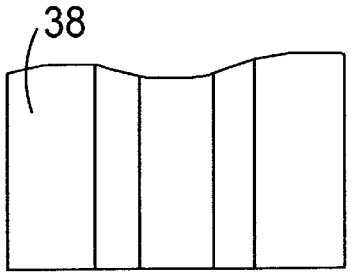
FIG. 3 is a fragmentary front view of an alternate embodiment utilizing a gusseted panel.

A gusseted panel 38, as illustrated in FIG. 3, can be used as an alternative embodiment with any of the structured embodiments disclosed herein. The gusset provides a flexible depth by allowing the panel to expand as required. The gusseted panel 38 design can be used in pairs, in combination with a single strip front and back to replace the single strip side panel 34 or in the front to replace the front panel 36. The fold-over design of a gusseted panel is known in the clothing industry and the applicability will be obvious to those skilled in the art when read in conjunction with the specification.

The dual pocket 16 provides a front dual pocket 42 as well as a flatter back pocket 46, as can be seen clearly in FIGS.

4 and 5. The backing 44 of the pocket 16 is approximately double the length of the front dual pocket 42. At approximately the midpoint, the aforenoted enclosing strip 48 is stitched to the inside of the backing 44 to provide the enclosed channel 54. The entire backing 44 can be a single or double layer of material, however if manufactured as a single layer, as shown herein, a secondary layer 56 must be added along a portion of the backing 44 to enable the formation of the flat pocket 46. The flat pocket 46 is provided with a zipper 50 or other means for closure. Although the pocket 46 illustrated is predominately flat with access along its length, other means of accessing the pocket 46 can be used. The bottom of the dual pocket 16 is prevented from swinging freely by securing strips 52 which can be single sided hook and loop, or fabric having hook and loop, snaps, etc., attached at the ends. The exact means of securing the dual pocket is not critical, however the pocket is designed with securing strips to maintain contact with the lower crutch.

Figure 6:
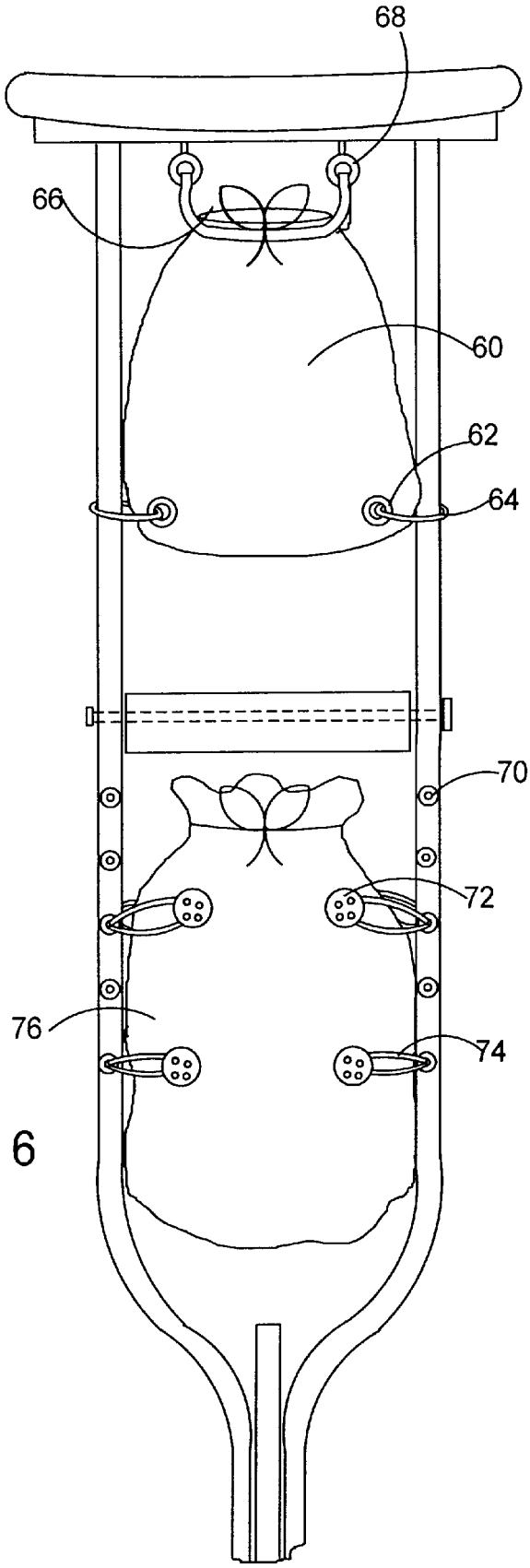
FIG. 6 is a crutch with two alternate pocket embodiments attached.

In FIG. 6 the foregoing structured pockets have been replaced by unstructured pouches 60 and 76. The upper pouch 60 has an unstructured design similar to a woman's pocketbook. A drawstring 66 is used to close the pouch 60 as well as fasten the pouch 60 to the eye hooks 68. Alternatively, additional ties, separate from the drawstring 66, can be affixed to the pouch 60 to secure the pouch 60 to the eye hooks 68. A pair of grommets 62 are placed in the bottom corners of the pouch 60 and then secured to the crutch 12 through use of ties 64. The use of bottom corner securing means prevents excessive movement of the pouch 60 during use. The grommets 62 can be replaced with buttons and secured to the crutch as described in conjunction with the lower pouch 76.

The lower pouch 76 is also a similar, unstructured configuration and has been secured to the crutch 12 through use of buttons 72 which have been secured to either side of the top and bottom of the pouch 76. The ties 74 are strung through holes 70 in the crutch 12 and tied or wrapped around the buttons 72. The ties 74 can be manufactured from decorative roping or leather and then tied, or elastic and simply looped around the buttons 72. The style of tie 74 will depend upon the style desired by the user.

Although the depth of the pockets is not critical, the positioning of the pockets in relationship to the user should be taken into consideration. Generally people on crutches have enough trouble maneuvering using the crutch without any added problems due to the bulkiness of the pockets. Therefore, the inner flat pocket 46 should remain relatively compact to avoid contact with the user's leg. The front dual pocket 42 would have little restriction as it will not be in contact with either the users arm or leg.

Figure 7:
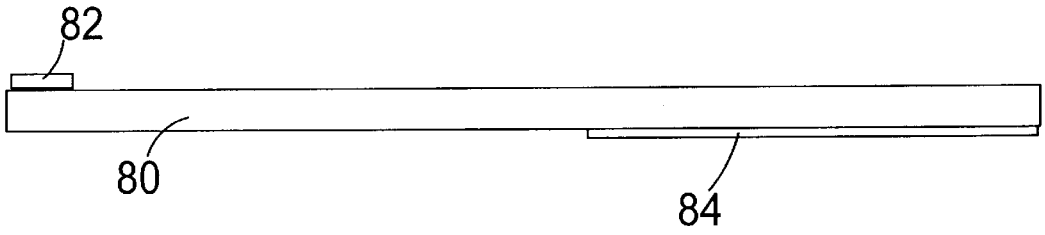
FIG. 7 is a side view of the document holder for use with the instant invention.
Figure 8:
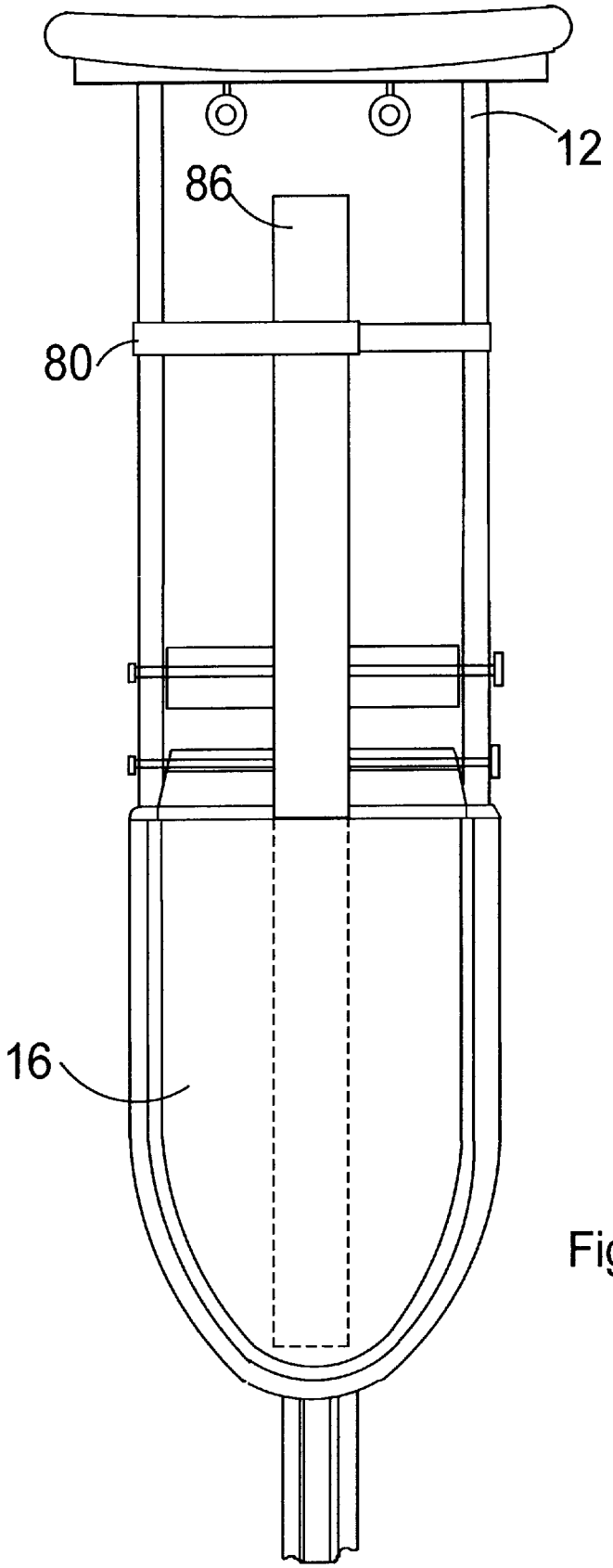
FIG. 8 is a front view of a document being carried using the lower pocket and the document holder of FIG. 7.

FIGS. 7 and 8 illustrate a document strap 80 for use with the instant invention. The document strap 80 is provided with a hook portion 82 on one end and a wool portion 84 at the opposite end of the opposing side. When used, the flap of the pocket 16 is placed inside the pocket 16 and the document 86 inserted into the pocket 16. The document strap 80 is then secured around the crutch 12 sides, preventing the document 86 from wobbling.

Figure 9:
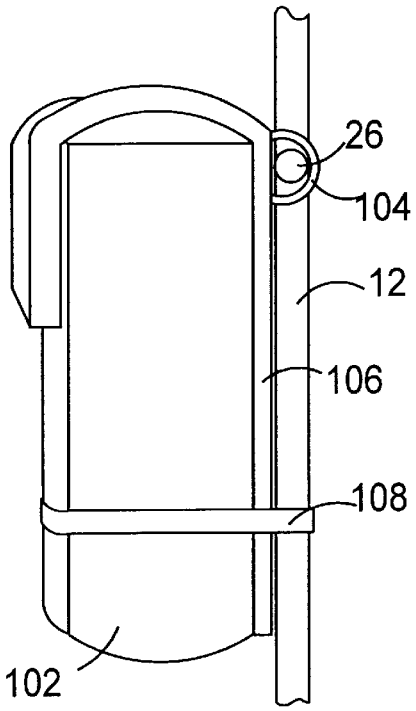
FIG. 9 is a cutaway perspective view of an alternate embodiment of a large crutch pocket for use on the lower portion of the crutch.

In the embodiment of FIG. 9, the pocket 102 has an exterior channel 104 which is secured to the back panel 106 and is dimensioned to receive the retaining bolt 26.

Figure 10:
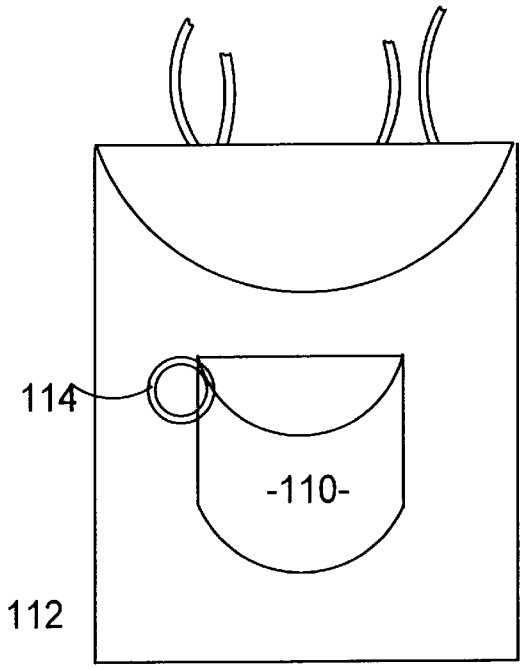
FIG. 10 is a front view of an alternate pocket containing a small pouch on the front of the pocket.

In FIG. 10 an outer pocket 110 has been added to the upper pocket 112. The outer pocket 110 can be dimensioned to hold small, frequently used items, such as credit cards, change, medication, etc. A key ring 114 can also be added to either the outer pocket 110 or the upper pocket 112, to hold the user's keys.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A crutch and pocket system combination for retaining articles, said crutch having a pair of vertical side rails with a top arm pad and a handle there below, said system comprising:

at least one pocket being attached to said crutch, a first of said at least one pocket having:

an open first end and a closed second end, a front panel, a back panel and a pair of side panels, a pocket closure member being affixed to said back panel and extending over said open first end, a first pocket channel member, said first pocket channel member being proximate said back panel and said open first end, a pair of ties, said ties being affixed to said back panel adjacent to said open end, said crutch having at least on pair of loops affixed to said top arm pad and a pocket retaining member, said pocket retaining member being attached between said vertical rails, said first pocket channel member being dimensioned to receive said pocket retaining member, wherein said first pocket is secured to said crutch through at least one of said ties affixed to said loops or said retaining member placed within said channel member and affixed to said vertical rails.

2. The crutch and pocket system of claim 1 wherein said first pocket retaining member is a bolt.

3. The crutch and pocket system of claim 1 wherein said back panel has a length greater than the length of said front panel, thereby forming said pocket closure member, said closure member being adjacent to, and extending over, said first end.

4. The crutch and pocket system of claim 1 wherein said side panels are gusseted to provide expansion.

5. The crutch and pocket system of claim 1 wherein said side panels are separate elements affixed to said front panel and said panel.

6. The crutch and pocket system of claim 1 further comprising a retaining strap, said retaining strap being adjacent to said second end and secured to said vertical side rail to minimize movement of said first pocket during use.

7. The crutch and pocket system claim 1 further comprising a second pocket combination being attached to said crutch below said first pocket, said second pocket combination having:

a front panel, a side panel, said side panel being affixed to a portion of said front panel;

a back panel, said back panel having a length at least twice the length of said front panel, a first side and a second side, said back panel being folded upon itself to form a U-shape, said U-shape having a first leg and a second leg, said first leg being affixed to said side panel, to form a pocket having an open end.

8. The crutch and pocket system of claim 7 further comprising an enclosing strip, and a retaining bolt, said enclosing strip being affixed to a crook formed by said U-shaped back panel to form a channel, said channel being dimensioned to receive, said retaining bolt through one of at least a pair of holes in said vertical side rails, thereby supporting said second pocket between said vertical rails.

9. The crutch and pocket system of claim 8 further comprising a secondary layer, said secondary layer being affixed to said second leg of said U-shape, to form a third pocket, said third pocket further comprising closeable access means.

10. The crutch and pocket system of claim 7 further comprising closure means, said closure means being adjacent to the first end of said second pocket.

11. The crutch and pocket system of claim 8 further comprising at least one retaining strap, said at least one retaining strap being affixed to said second pocket adjacent to said second end and having a length sufficient to secure said second end to said crutch, thereby maintaining said second pocket adjacent to said crutch.

12. The crutch and pocket system of claim 1 wherein said channel is placed on an interior portion of said back panel.

13. A crutch and multi-pocket system combination for retaining articles, said crutch having a pair of vertical side rails with a horizontal top rail, and at least one pair of holes in each of said vertical side rails, a first pocket being attached to said crutch, said first pocket having an open first end and a closed second end and being formed from:

a first pocket front panel, at least one first pocket side panel, said at least one first pocket side panel being positioned between said first pocket front panel and a first pocket back panel;

said first pocket back panel, said first pocket back panel having a length greater than the length of said first pocket front panel, thereby forming a closure member, said closure member being adjacent to and extending over, said open first end;

a first pocket securing member, said first pocket securing member being affixed to said first pocket back panel adjacent to said first end, a pocket receiving member, said pocket receiving member being affixed to said crutch horizontal top rail and dimensioned to receive said pocket securing member, at least one first retaining strap, said at least one first retaining strap being affixed to said first pocket adjacent to said second end to secure said second end to the crutch, a lower pocket attached to said crutch below said first pocket, said lower pocket having an open first end and a closed second end and being formed from:

a lower pocket front panel, at least one lower pocket side panel, said at least one lower pocket side panel being positioned between said lower pocket front panel and a lower pocket back panel;

said lower pocket back panel, said lower pocket back panel having a length at least twice the length of said lower pocket front panel, said lower pocket back panel being folded upon itself to form a U-shape having a first leg, a second leg and a crook, said first leg of said U-shape being affixed to said lower pocket front panel, an enclosing strip, said enclosing strip being affixed to said back lower pocket panel at said crook to form a channel, said channel receiving a retaining bolt secured to the side rails, a secondary layer, said secondary layer being affixed to a second leg of said U-shape, to form a second lower pocket, said second lower pocket further comprising closeable access, closure means, said closure means being adjacent to the first end of said lower pocket, at least one second retaining strap, said at least one second retaining strap being affixed to said lower pocket adjacent to said second end and having a length sufficient to secure said second end to said crutch.

14. The method of carrying articles by a person using a crutch by employing a pocket system in combination with said crutch, said crutch having a pair of vertical side rails with a horizontal top rail, and at least one pair of holes in each of said vertical side rails, and at least one retaining bolt secured between said vertical side rails, a first pocket, said first pocket having an open first end and a closed second end and being formed from:

a first pocket front panel, at least one first pocket side panel, said at least one first pocket side panel being positioned between said first pocket front panel and a first pocket back panel;

a first pocket back panel, said first pocket back panel having a length greater than the length of said first pocket front panel, thereby forming a closure member, said closure member being proximate, and extending over, said open first end;

a first pocket securing member, said first pocket securing member being affixed to said first pocket back panel proximate said first end, a pocket receiving member, said pocket receiving member being affixed to said crutch horizontal top rail and dimensioned to receive said first pocket securing member, at least one first retaining strap, said at least one retaining strap being affixed to said first pocket proximate said second end to secure said second end to the crutch, a lower pocket, said lower pocket having an open first end and a closed second end and being formed from:

a lower pocket front panel, at least one lower pocket side panel, said at least one lower pocket side panel being positioned between said lower pocket front panel and a lower pocket back panel;

said lower pocket back panel, said lower pocket back panel having a length at least twice the length of said lower pocket front panel, said lower pocket back panel being folded upon itself to form a U-shape having a first leg, a second leg and a crook, said first leg of said U-shape being affixed to said lower pocket front panel, an enclosing strip, said enclosing strip being affixed to said lower pocket back panel at a crook of said U-shape to form a channel, said channel being dimensioned to receive said retaining bolt, a secondary layer, said secondary layer being affixed to a second leg of said U-shape, to form a second lower pocket, said second leg further comprising access means to access said pocket, a closure member, said closure member being proximate the first end of said lower pocket, at least one retaining strap, said at least one retaining strap being affixed to said pocket proximate said second end comprising the steps of:

affixing said first pocket securing member to said first pocket receiving member, affixing said at least one first retaining strap around said enclosed second end of said first pocket and to said vertical side rails, placing said retaining bolt through a first of said at least one pair of holes;

placing said channel of said lower pocket, proximate said retaining bolt, sliding said retaining bolt through said channel and securing said retaining bolt within said vertical side rails, affixing said at least one second retaining strap around said closed second end of said lower pocket said vertical side rails, thereby enabling a person using a crutch to place articles within said pocket during use of said crutch.

* * * * *